US007140342B1

(12) United States Patent
Murray

(10) Patent No.: US 7,140,342 B1
(45) Date of Patent: Nov. 28, 2006

(54) SLOTTED CYLINDRICAL TUBE ROTARY VALVE ASSEMBLY

(76) Inventor: Michael J. Murray, 1644 S. Raymond Ave., Alhambra, CA (US) 91803

( * ) Notice: Subject to any disclaimer, the term of this patent is extended or adjusted under 35 U.S.C. 154(b) by 0 days.

(21) Appl. No.: 11/367,105

(22) Filed: Mar. 4, 2006

Related U.S. Application Data

(60) Provisional application No. 60/712,844, filed on Sep. 1, 2005.

(51) Int. Cl.
*F01L 7/00* (2006.01)

(52) U.S. Cl. ..... 123/190.1; 123/80 BA; 251/283

(58) Field of Classification Search ..... 123/190.1, 123/190.2, 190.5, 190.17, 80 BA, 80 R; 251/283, 304
See application file for complete search history.

(56) References Cited

U.S. PATENT DOCUMENTS 1,262,602 A * 4/1918 Stedman ..... 123/65 BA
2,730,088 A * 1/1956 Hyde ..... 123/59.1
4,119,077 A 10/1978 Vallejos
5,361,739 A 11/1994 Coates
5,690,069 A * 11/1997 Huwarts ..... 123/190.2
5,878,707 A 3/1999 Ballard
5,906,180 A 5/1999 Wilke
6,443,110 B1 9/2002 Qattan

* cited by examiner

*Primary Examiner*—Stephen K. Cronin
*Assistant Examiner*—Katrina Harris
(74) *Attorney, Agent, or Firm*—David H. Chan

(57) ABSTRACT

This invention is a slotted cylindrical rotary valve assembly for an internal combustion engine, comprising of two sets of gear driven slotted cylindrical tubes in a cradle apparatus. Each set has two tubes located co-axially and rotates co-axially, and each tube is slotted to allow for improved transport of a fuel/air mixture and exhaust. In one embodiment, an intake set of tubes transport fuel/air through apertures on the tubes. The exhaust set of tubes transport exhaust through apertures (slots) on the tubes. The rotation of the tubes brings the apertures in timely alignment to allow fuel/air injection and exhaust in synchronization with the cyclical operation of the pistons in the combustion chambers. Effective sealing in one embodiment is achieved by using a modified piston with an extension wall extending longitudinally from the top of the piston to seal intake and exhaust orifices at the top of the chamber.

15 Claims, 4 Drawing Sheets

SLOTTED CYLINDRICAL TUBE ROTARY VALVE ASSEMBLY

This patent application claims priority to U.S. Provisional Patent Application No. 60/712,844, filed Sep. 1, 2005.

BACKGROUND OF THE INVENTION

1. Field of the Invention

This invention relates to an internal combustion engine, and more specifically, to an improved apparatus and method of transporting combustible material transport to, and removing of exhaust from, the cylinder chamber of combustion.

2. Discussion of Related Arts

The operation of the internal combustion engine is organic and complex. The primary combustion occurs in the cylinder/chamber apparatus of the internal combustion engine. This combustion process can be likened to a cyclical process. The cycle first begins with an intake action, with a piston moving down a combustion chamber (cylinder apparatus) and drawing in a fuel/air mixture. Then, the piston compresses the fuel/air mixture as it travels in the combustion chamber that is temporarily sealed. Moreover, the compressed combustible fuel/air mixture is guided towards the ignition component and ignited. Later, at the ignition stage, the combusted gases exert a force on the piston, pushing it downward and thereby transmitting a driving force through a connecting rod to force the crankshaft into a power-generating stroke. Lastly, in a timed and semi-spontaneous action, the burned fuel/air mixture exits the combustion chamber via an exhaust valve.

The major practical flaws of the conventional poppet valve and spring assembly are inherent in the fact that valves are tasked with the process of rapidly pounding and the valve springs are tasked with the job of providing tension to open and close at an alarmingly high rate of speed. Over time, this process can become problematic since the poppet valve functions can sometimes fall slower than the operations of the rest of the engine, especially during a rate of high RPM. This is not to mention the wear and tear to the components caused by repeated pounding and moving in and out of high-tension positions.

Rotary valve assemblies have been proposed as replacements to the conventional poppet valve-based assemblies. Implementing rotary valve assemblies requires adequate cooling functions as well as aptly needed sealing. Some attempts have been made to utilize other components, like inserts, and compounds, like ceramics, to address the issues of sealing and cooling. These alien components, however, are not conducive to the use and production of universally accessible materials and parts. This not only makes such uses cost prohibitive, but does not allow for a universal distribution and acquisition of these parts and components. Other attempts at sealing have not derived a viable and realistic approach with regard to the durability needed in the internal compartments of an engine. The additional components utilized in these attempts for sealing and cooling minimize the advantages of rotary valve assemblies and limit their commercial viability.

Hence, what is needed is a proper implementation of a rotary valve assembly that meets the specific requirements of cooling and sealing, without utilizing components that are susceptible to issues of durability, complexity, cost, and accessibility. The present invention maximizes engine performance by enhancing its efficiency and by addressing the cooling and sealing inadequacies, as well as by eliminating some standard components that will no longer be required as part of an improved design.

OBJECTS OF THE INVENTION

It is an object of this invention to negate the need for various moving parts that make up the inner-workings of the conventional internal combustion engine, specifically the camshaft assembly, lifters, push rods, rocker arm assemblies, poppet valve and spring assemblies;

It is an object of this invention to eliminate unnecessary pounding and like movements that can prove to be inefficient, eliminating unneeded functionalities, and alleviating exertion of the inner workings of the conventional internal combustion engine;

It is an object of this invention to provide a functional rotary valve design, with all its advantage in efficiency in power generation, that can be applied to non-rotary valve based internal combustion engines;

It is an object of this invention to provide better cooling and sealing systems than those that exist within previous and current designs of rotary valve assemblies and the conventional internal combustion engine;

It is an object of this invention to eliminate lost-power and parasitic energy release related to the inner workings and parts that generate the forces directed to the drive train in communication with an internal combustion engine;

It is an object of this invention to derive dynamic compression effects that can be modified;

It is an object of this invention to provide an improved design of a rotary valve assembly that allows for a more efficient means of fuel consumption that can supersede that of the conventional internal combustion engine;

Lastly, it is an object of this invention to provide a less cost prohibitive engine that performs better than the conventional internal combustion engine.

SUMMARY OF THE INVENTION

The present invention relates to a rotary valve head assembly that comprises of a plurality of sets of cylindrical tubes situated within a holding cradle apparatus. Each set of cylindrical tubes comprise of an inner and an outer slotted cylindrical tubes, located co-axially. The dual tube per set design allows for reciprocal spinning movement generally. In one embodiment, a set of intake cylindrical tubes and a set of exhaust cylindrical tubes are situated above multiple combustion chambers of an internal combustion engine. Both sets of cylindrical tubes are driven by a gear-like assembly, which in turn is in communication with the crankshaft assembly. Each cylindrical tube contains slotted apertures strategically placed to act as a transport mechanism to and from the combustion chambers. The tubes are timed to spin reciprocally so as to allow for time synchronization with the conventional cyclical movement of a piston. In other embodiments, multiple sets of cylindrical tubes are coupled with multiple chambers. The cylindrical tubes obviate the needs for conventional poppet valve assemblies and eliminate the pounding associated with such components.

In one embodiment, the rotational movement of a set of intake slotted cylindrical tubes incorporates the timed transport into a combustion chamber a fuel/air mixture through the slots or apertures on the tubes. At a specific moment in time, the apertures on the tubes come into alignment and the fuel/air mixture is timed to go through those apertures, and into the chamber (cylinder) via a side orifice placed generally high in the combustion chamber. After combustion, a set of exhaust slotted cylindrical tubes handle the exhaust, which exits from the chamber through an orifice high in the cylinder, across from the intake orifice. The exhaust exits through the slots or apertures on the cylindrical tubes at a moment in time when the apertures are aligned by the rotational movement of the tubes. The slots or apertures on the tubes, intake and exhaust, are timely aligned by the rotational movement of the tubes and are driven by a gear assembly in communication with the cyclical operation of the pistons in the chambers.

In one embodiment, an effective sealing system is comprised of a piston, with a wall extension extending above the piston. This wall extension acts to close the intake and exhaust orifices of the chamber. The wall extension encloses a hollow area on top of the piston. During the operation of the piston, the pressure in the hollow area exerts a radially outward force against the wall extension so that the extension can effectively seal the intake and exhaust orifices of the chamber. In another embodiment, a plurality of rings are placed on the extension wall to provide additional sealing capacities.

Hence, conventional poppet valves and other components that suffer constant pounding and wear and tear can be eliminated. In addition, because components in the present invention do not suffer such constant pounding, their durability far exceeds those of their conventional counterparts and hence the life of the engine is prolonged. Also, embodiments of the present invention eliminate the need for expensive and hard to find materials such as ceramics that are required in prior rotary valve implementations. For example, the piston extension wall can be made from the same material that makes up the piston and no additional special materials are needed to achieve effective sealing.

Embodiments of rotary valve assembly of the present invention overcome several shortcomings of the standard valve assembly. Firstly, the rotary valve of the present invention can provide enhanced performance since its primary functionality is to spin and not to pound. This spinning movement allows for a faster response in accordance with the operation of the crankshaft, leading to a higher performance engine. Secondly, no springs are needed and therefore no tension is required to operate moveable parts. This reduces the stress that would have been placed on the moveable parts. Thirdly, the use of a rotary valve assembly can eliminate many moving parts that would have been necessary in a standard engine, thereby eliminating inefficiencies and focusing the energy of the engine to the primary drive train. Additionally, the elimination of these adjustable moveable parts allows for the expansion of the top-end of the engine.

In one method of the invention, an embodiment of the rotary valve system of the present invention is adapted to replace the head of a conventional poppet valve system of an internal combustion engine. For example, the head of an existing engine with a poppet valve system can be removed entirely and replaced by a rotary valve head embodiment of the present invention. In another embodiment, the pistons of a conventional engine are replaced with the piston embodiments of the present invention, which, with its wall extensions, provide effective sealing to accommodate for the replacement of the poppet valves with rotary valves. The entire replacement procedure can be standardized to provide an effective after-market modification to existing engines to improve engine efficiency, leading to higher performance and gas mileage.

BRIEF DESCRIPTION OF THE DRAWINGS

These and other features, aspects and advantages of the present invention will become better understood with regard to the following description, appended claims and accompanying drawings where:

DETAILED DESCRIPTION OF THE INVENTION

Figure 1:
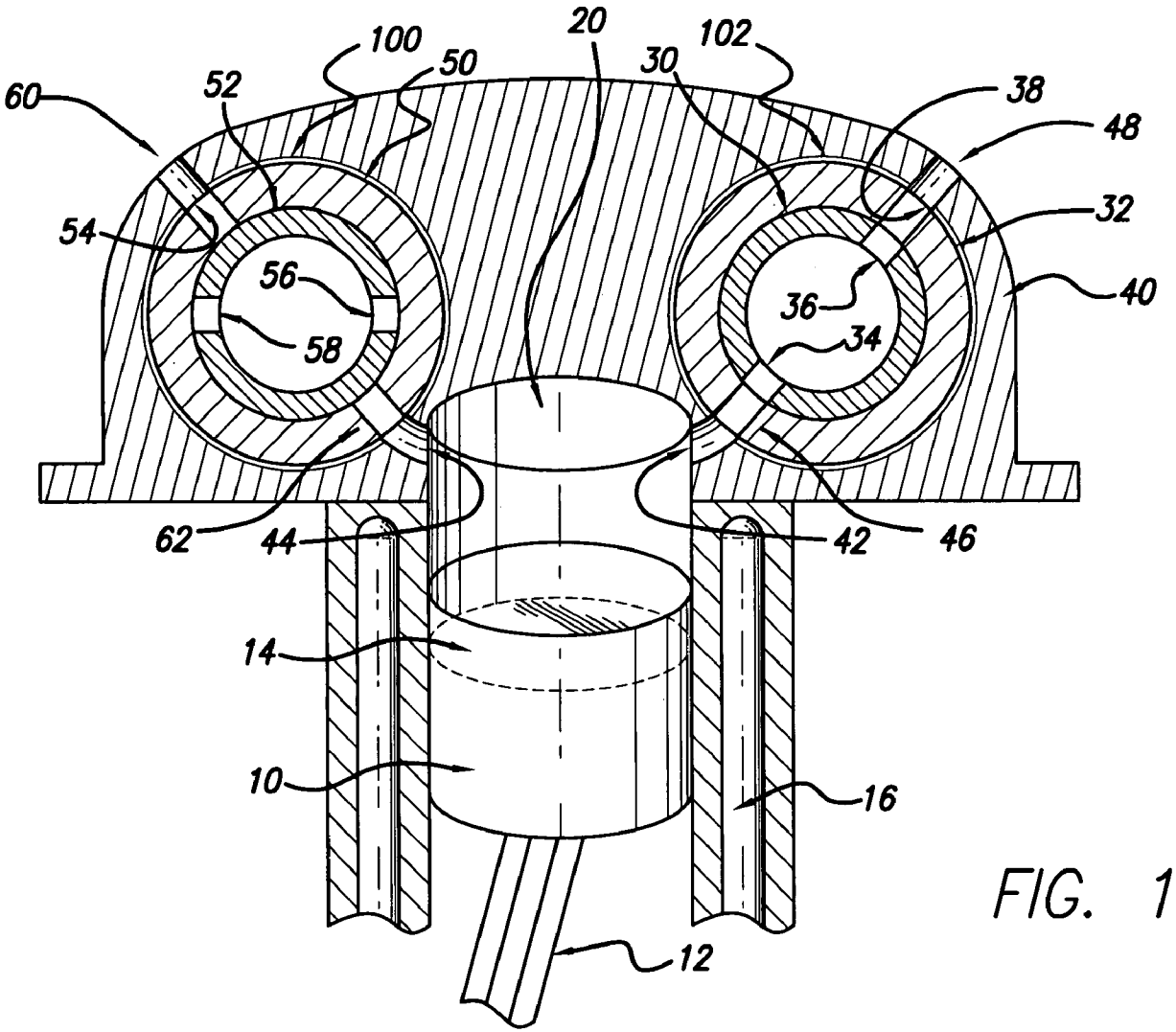
FIG. 1 is a cross-sectional depiction of an embodiment of the slotted cylindrical tube rotary valve assembly of the present invention.

FIG. 1 depicts a cross-sectional view of an embodiment of the present invention. In one embodiment, rotary assembly valve (head unit cradle) 40 comprises of two sets of rotary valves. FIG. 1 illustrates an example configuration where the right side of the piston is the intake side and the left side is the exhaust side. It will be apparent to those skilled in the arts that in other embodiments the configuration can be reversed. In this example configuration, on the right hand side, inner slotted cylindrical tube 30 is located co-axially with outer slotted cylindrical tube 32. In one embodiment, inner slotted cylindrical tube 30 comprises of slots or apertures 34 and 36. Inner slotted cylindrical tube 30 rotates co-axially, relative to outer slotted cylindrical tube 32. In another embodiment, outer slotted cylindrical tube 32 and inner slotted cylindrical tube 30 both rotate, but in opposite direction. At a certain time during the rotation, apertures 34 and 36 of inner slotted cylindrical tube 30 will come into alignment apertures 38 and 46 of outer slotted cylindrical tube 32. In one embodiment, all four apertures are timed to align with intake injection 48 and intake orifice 42, as shown in FIG. 1. When this occurs the intake is in the "open" position and fuel/air mixture is drawn into combustion chamber 20. At other times, the rotation of inner slotted cylindrical tube 30 moves apertures 34 and 36 out of alignment with respect to apertures 38 and 46 of outer slotted cylindrical tube 32, as well as with respect to intake injection 48 and intake orifice 42, arriving at the "closed" position. Hence, the rotation of inner and outer slotted cylindrical tubes can be configured to time the "open" and "closed" positions to coordinate with the activities within combustion chamber 20 and other components of the engine.

Fluidic cooling chambers 16 embrace combustion chamber 20, providing the necessary cooling. It is noted here the termed "combustion chamber" is used to describe what is more commonly known as a cylinder within an internal combustion engine. But for clarity's sake, and to distinguish it from the cylindrical tubes of the present invention, the term "combustion chamber" is used. In one embodiment, coolant jackets 100 and 102 wrap around cylindrical tubes 30 and 50 to provide adequate cooling.

In one embodiment, the left (exhaust) side has a set of slotted cylindrical tubes—inner slotted cylindrical tube 52 and outer slotted cylindrical tube 50. In one embodiment, inner cylindrical tube 52 comprises two apertures (slots) 56 and 58 and outer cylindrical tube 50 comprises two apertures (slots) 54 and 62. Again, as with the intake side, inner slotted cylindrical tube 52 rotates coaxially in relation to outer slotted cylindrical tube 50 in one embodiment. In another embodiment, both cylindrical tubes 50 and 52 rotate, but in opposite direction. The rotational motion allows apertures to arrive at an "open" position where they come into alignment with exhaust 60 and exhaust orifice 44, and allows exhaust to escape from combustion chamber 20 after an explosion. In contrast, for example, FIG. 1 depicts the "closed" position, since apertures 56 and 58 of inner slotted cylindrical tube 52 are not in alignment with apertures 54 and 62 of outer slotted cylindrical tube 50. Also, in the "closed" position, exhaust orifice 44 is effectively sealed off, preventing any exhaust from escaping from combustion chamber 20 and maintaining the pressure inside the chamber.

Figure 3A:
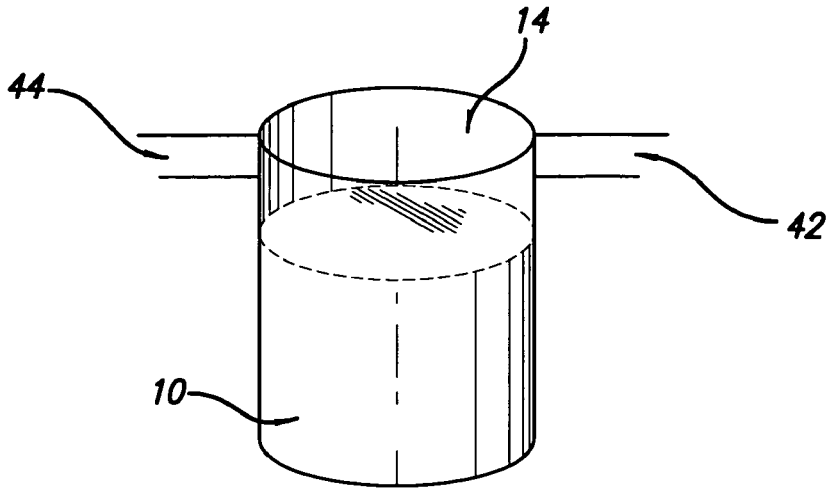
FIG. 3A is a drawing showing one position of the piston with an extension wall within the combustion chamber of the present invention.
Figure 3B:
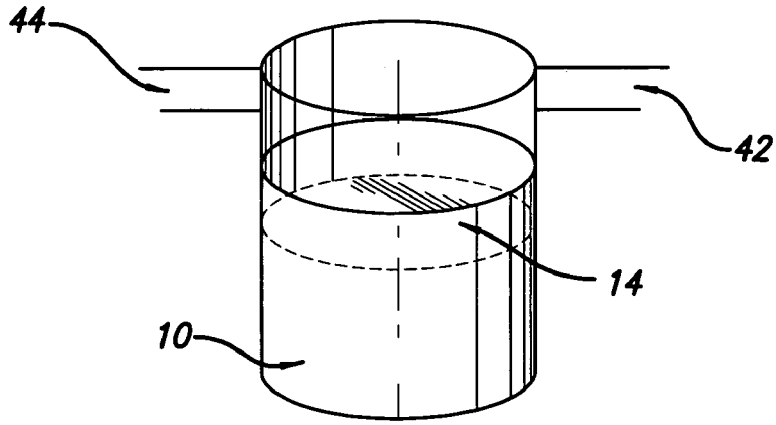
FIG. 3B is a drawing showing another position of the piston with an extension wall within the combustion chamber of the present invention.

Combustion chamber 20 is comprised of piston 10 and push rod 12. Piston 10 is a cylindrical piston with extension wall 14, as depicted separately in the cross-section view of FIG. 4. The operation of the piston is now further illustrated in conjunction with FIGS. 3A and 3B. FIG. 3A shows piston 10 at an "up" position where extension wall 14 has sealed off intake orifice 42 and exhaust orifice 44. In FIG. 3B, piston 10 is at a "down" position after an explosion has occurred in the chamber.

Once the intake rotary valve opens up (i.e. the apertures of cylindrical tubes 30 and 32 are aligned with fuel injection 48 and intake orifice 42), the air/fuel mixture is drawn into combustion chamber 20 as piston 10 moves to the "down" position as depicted in FIG. 3B. In one embodiment, exhaust orifice 44 is closed when this occurs to ensure that intake comes in through intake orifice 42. Then, when piston 10 reaches its lower limit it will rebound upward toward the top of combustion chamber 20. When it reaches near the top the air/fuel mixture will be ignited by electrical spark and then the explosion will push piston back down, driving the other components such as the crankshaft through connecting rod 12. As shown in FIG. 3A, because extension wall 14 extends beyond the top of piston 10, when piston 10 reaches the "top" position in FIG. 3A, extension wall 14 effectively seals off both intake orifice 42 and exhaust 44 orifice and maintains the pressure within combustion chamber 20.

In another part of the engine cycle, once the piston has reached its lower limit after experiencing downward force from the explosion, it will rebound back up and pushes the exhaust out through exhaust orifice 44. In one embodiment when this occurs, intake orifice 42 is closed off to ensure that exhaust exits through exhaust orifice 44.

Figure 4:
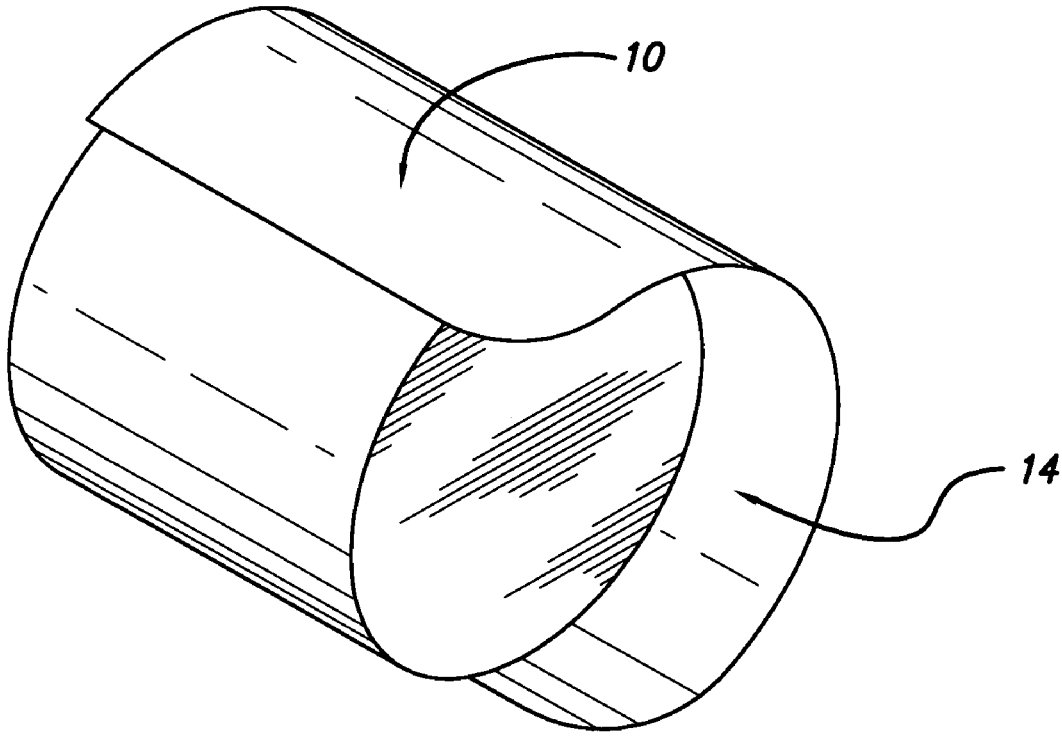
FIG. 4 is a cut-away drawing showing an embodiment of a piston with an extension wall in the present invention.

The placement of extension wall 14 is one advantage of the present invention. Extension wall 14 effectively seals off intake and exhaust orifices 42 and 44 when the piston reaches the "top" position. FIG. 4 is a cut-away drawing showing an embodiment of a piston with an extension of the present invention. Extension wall 14 takes advantage of the fact that the pressure from the gas within the hollow area enclosed by extension wall 14 exerts an outward force (as expanding radially from center of the cylindrical shaped piston toward the extension wall). The outward force of the gas naturally pushes against extension wall 14 toward orifices 42 and 44. The use of this force allows this embodiment of the present invention to achieve effective sealing. In this manner, extension wall 14 achieves effective sealing without poppet valves and other components that are required in conventional engines and prior implementations of rotary valves. In another embodiment, a plurality of rings are placed on the extension wall to provide additional sealing capacities.

Hence, conventional poppet valves and other components that suffer from constant pounding and wear and tear can be eliminated. Such components, which are normally required in a conventional engine and other implementations of the rotary valve engine, also generate an enormous amount of friction, heat, reducing the overall efficiency of the engine. By replacing these components with components that do not require pounding motions, and by the reduced friction achieved by the rotary valves, the present invention greatly increases engine efficiency. In addition, because components in the present invention do not suffer such constant pounding, their durability far exceeds those of their conventional counterparts and hence the life of the engine is prolonged.

In one embodiment, sealing is achieved by engaging both sets of cylinder tubes rotating on cradles with strategically placed cylinder bearing units encasing the cylindrical tubes, and further encased with slot-fitted seals on both sides of the piston chamber. In one embodiment, a moveable seal door or a moveable trap or other sealing component is placed on the intake orifice and on the exhaust orifice. In one embodiment, the cylindrical tubes are working in tandem and conjoined by one primary gear assembly, so that they are in synchronization with the operation of the pistons within the chambers.

In another embodiment, head assembly 40 has an insert protruding down into chamber 20. In one embodiment, the insert (not shown in FIG. 1) can be dome-shaped, reducing the volume on the top of the piston enclosed by the extension wall 14. In another embodiment, the insert can be rectangular-shaped or in other shapes for the purpose of reducing the volume on top of piston 10 enclosed by extension wall 14. The reduced volume increases the pressure within chamber 20 when piston 10 moves into the "top" position.

Figure 2:
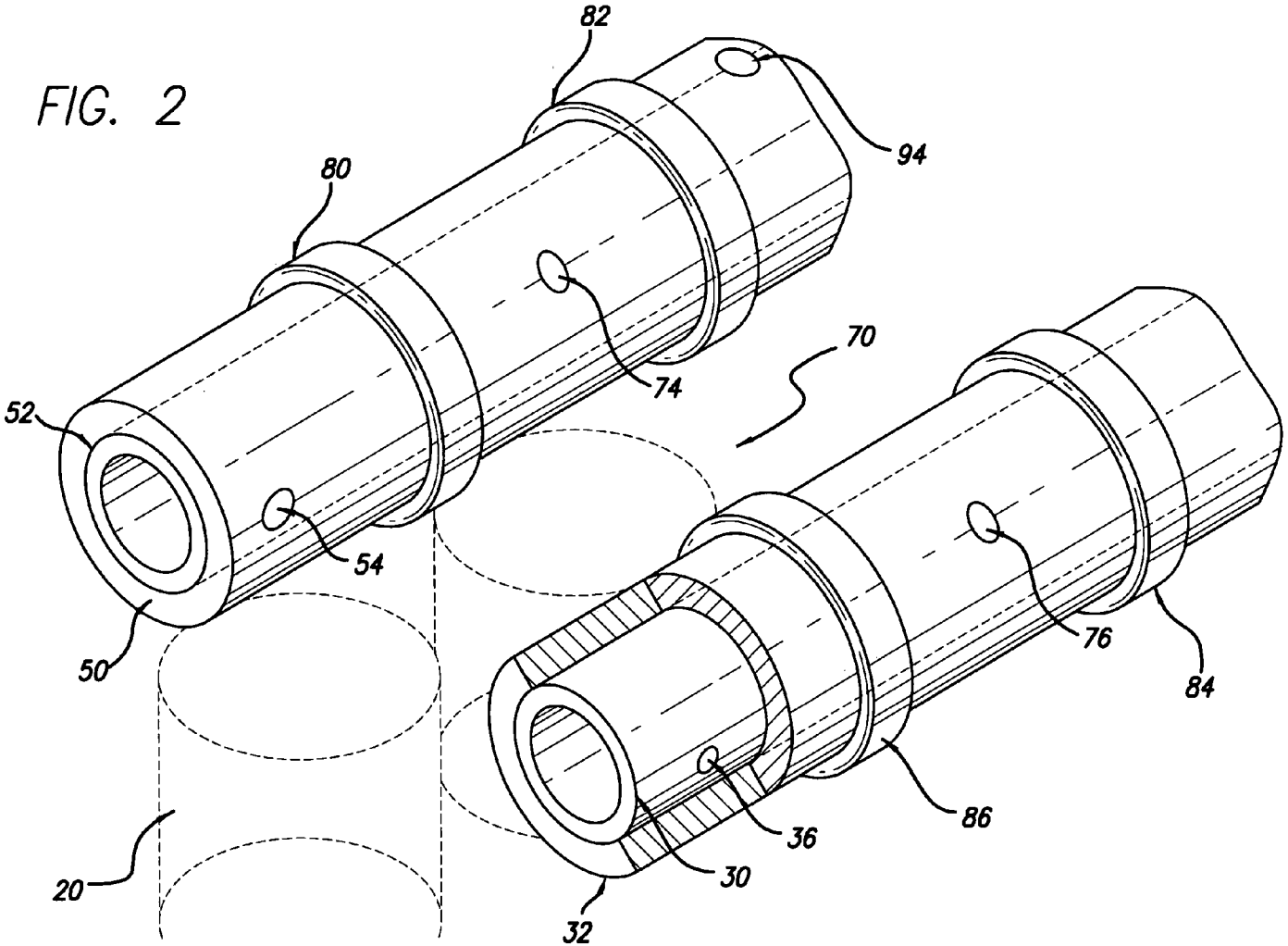
FIG. 2 is a drawing depicting an abstract view of the relationship between the slotted cylindrical tubes and piston (combustion) chambers of an embodiment of the present invention.

FIG. 2 is a cut-away drawing depicting the relative position of the cylindrical tubes and the pistons in one embodiment of the present invention. In FIG. 2, combustion chambers 20 and 70 are indicated by dotted lines forming cylindrical shapes. The two chambers shown are sandwiched between the two sets of slotted cylindrical tubes: outer tube 50 and inner tube 52 for the exhaust, and outer tube 32 and inner tube 30 for the intake. It can be appreciated by those skilled in the art that FIG. 2 illustrates an example configuration and that other configurations of rotary valves and chambers are possible. To correlate further with FIG. 1, it can be seen that FIG. 1 provides a cross sectional view from the lower left hand corner of FIG. 2, a view that faces combustion chamber 20 as well as the cut-away cross-sectional view of the two sets of slotted cylindrical tubes.

In one embodiment, for each piston/combustion chamber, there is a set of eight apertures to provide transport of fuel/air mixture as well as exhaust—four for the intake and four for the exhaust. Hence for example, for combustion chamber 20, apertures 34 and 36 of inner slotted cylindrical tube 30 as well as apertures 38 and 46 of outer slotted cylindrical tube 32 provide an intake pathway for combustion chamber 20. FIG. 2 has partially cut away outer slotted cylindrical tube 32 to provide a view into inner slotted cylindrical tube 30 and aperture 36 therein. On the exhaust side, FIG. 2 shows inner slotted cylindrical tube 50 and outer slotted cylindrical tube 52 in relation to combustion chamber 20. Aperture 54 of outer slotted cylindrical tube 52 is shown also in FIG. 2. The outer apertures 56, 58 and inner aperture 62 are hidden from view in FIG. 2. Also shown in FIG. 2 are bearings (with fasteners) 80, 82, 84 and 86 that hold both sets of slotted cylindrical tubes in place within rotary valve assembly (cradle) 40 in FIG. 1.

In another embodiment, in like manner, an entire set of apertures is provided for combustion chamber 70, but on the same sets of inner and outer slotted cylindrical tubes (i.e. 30, 32, 50, and 52). Shown in FIG. 2 are aperture 76 of intake outer slotted cylindrical tube 32 and aperture 74 of exhaust outer slotted cylindrical tube 52. On the intake side, there are three more apertures not shown in this view of FIG. 2—one more for outer slotted cylindrical tube 32, and two within inner slotted cylindrical tube 30. Similarly on the exhaust side, there are three more apertures not shown in this view of FIG. 2—one more for outer slotted cylindrical tube 52, and two within inner slotted cylindrical tube 50. Apertures 74 and 76, as well as the six apertures not shown, are appropriately off set from the eight apertures serving combustion chamber 20, so that the operational cycles of piston 10 (within combustion chamber 20) and the operational cycles of the piston within combustion chamber 70 can be aligned to provide continuous power. In other words, because of the rotational motion of the slotted cylindrical tubes, the location of the apertures on the inner and outer slotted cylindrical tubes provide a timing mechanism. The gear-driven cylindrical tubes are timed with the pistons to operate as a cooperative, synchronized fashion as required in an internal combustion engine. Therefore, it can be appreciated by those skilled in the arts the aperture locations depicted in FIGS. 1 and 2 are for illustrative purposes only. The precise locations have to be decided in accordance with the tuning and operation of each engine. Finally, it is to be understood that FIG. 2 illustrates an example configuration only, and that it will be apparent to those skilled in the art that the design of the cylindrical tubes and apertures that make up the rotary valve assembly can be adapted to an engine with a number of combustion chambers (cylinders) (e.g. 4 or 6 or any other number). For example, aperture 94 is depicted in FIG. 2 and potentially can be part of another set of apertures that serve the third combustion chamber/piston.

In one method of the invention, the rotary valve system of the present invention is adapted to replace the head of a conventional poppet valve system of an internal combustion engine. For example, the head of an existing engine with a poppet valve system can be removed entirely and replaced by a rotary valve head embodiment. In another embodiment, the pistons of the existing engine are replaced with the piston embodiments of the present invention, which with their extension walls provide effective sealing to accommodate for the replacement of the poppet valves with rotary valves. The entire replacement procedure can be standardized to provide an effective after-market modification to existing engines to improve engine efficiency, leading to higher performance and gas mileage.

Thus, a slotted cylindrical tube rotary valve and a method of improving a conventional engine are described in conjunction with one or more specific embodiments. The invention is defined by the claims and their full scope of equivalents.

What is claimed is:

1. An internal combustion engine, comprising:

a combustion chamber comprising:

an intake orifice;

an exhaust orifice; and a piston with an extension wall extending longitudinally beyond the top of said piston; and a rotary valve assembly situated on top of said combustion chamber comprising:

an outer intake cylindrical tube with a plurality of outer intake apertures;

an inner intake cylindrical tube with a plurality of inner intake apertures;

an outer exhaust cylindrical tube with a plurality of outer exhaust apertures; and an inner exhaust cylindrical tube with a plurality of inner exhaust apertures;

wherein said inner intake cylindrical tube is adapted to rotate co-axially in relation with said outer intake cylindrical tube to allow air or fuel to enter into said combustion chamber through said outer intake apertures and said inner intake apertures during operation of said combustion chamber;

wherein said inner exhaust cylindrical tube is adapted to rotate co-axially in relation with said outer exhaust cylindrical tube to allow exhaust to exit said combustion chamber through said outer exhaust apertures and said inner exhaust apertures during operation of said combustion chamber;

wherein said outer intake apertures, said inner intake apertures, said outer exhaust apertures, and said inner exhaust apertures are aligned to coordinate with intake and exhaust cycles of operation of said piston in said combustion chamber.

2. The internal combustion engine of claim 1 wherein said extension wall seals off said intake orifice and said exhaust orifice during operation of said piston.

3. The internal combustion engine of claim 1 wherein locations of said outer intake apertures, said inner intake apertures, said outer exhaust apertures, and said inner exhaust apertures are placed in an alignment according to the timing of the cyclical operation of said piston.

4. The internal combustion engine of claim 1 wherein locations of said outer intake apertures, said inner intake apertures, said outer exhaust apertures, and said inner exhaust apertures are placed in an alignment according to the timing of the cyclical operation of a plurality of pistons in said internal combustion engine.

5. The internal combustion engine of claim 1 wherein said outer intake cylindrical tube rotates in an opposite direction as the rotational motion of said inner intake cylindrical tube.

6. The internal combustion engine of claim 1 wherein said outer exhaust cylindrical tube rotates in an opposite direction as the rotational motion of said inner exhaust cylindrical tube.

7. The internal combustion engine of claim 1 wherein said outer intake cylindrical tube is stationary.

8. The internal combustion engine of claim 1 wherein said outer exhaust cylindrical tube is stationary.

9. The internal combustion engine of claim 1 wherein a plurality of fasteners hold in place said outer and inner intake cylindrical tubes and said outer and inner exhaust cylindrical tubes.

10. The internal combustion engine of claim 1 wherein said outer and inner intake cylindrical tubes and said outer and inner exhaust cylindrical tubes are surrounded by coolant jackets.

11. The internal combustion engine of claim 1 wherein said intake orifice is sealed by a movable sealing means.

12. The internal combustion engine of claim 1 wherein said exhaust orifice is sealed by a movable sealing means.

13. The internal combustion engine of claim 1 wherein said rotary valve assembly further comprises of an insert fitted to protrude into the top of said combustion chamber to reduce the volume between said rotary valve assembly and said piston.

14. A method for improving an conventional internal combustion engine, comprising:

replacing the piston in said conventional internal combustion engine with a modified piston with extension wall extending longitudinally beyond the top of said piston;

replacing the head assembly of said conventional internal combustion engine with a rotary valve assembly comprising:

an outer intake cylindrical tube with a plurality of outer intake apertures;

an inner intake cylindrical tube with a plurality of inner intake apertures;

an outer exhaust cylindrical tube with a plurality of outer exhaust apertures; and an inner exhaust cylindrical tube with a plurality of inner exhaust apertures;

wherein said inner intake cylindrical tube is adapted to rotate co-axially in relation with said outer intake cylindrical tube to allow air or fuel to enter into said combustion chamber through said outer intake apertures and said inner intake apertures during operation of said combustion chamber;

wherein said inner exhaust cylindrical tube is adapted to rotate co-axially in relation with said outer exhaust cylindrical tube to allow exhaust to exit said combustion chamber through said outer exhaust apertures and said inner exhaust apertures during operation of said combustion chamber;

wherein said outer intake apertures, said inner intake apertures, said outer exhaust apertures, and said inner exhaust apertures are aligned to coordinate with intake and exhaust cycles of operation of said piston in said combustion chamber.

15. An internal combustion engine, comprising:

a head;

an intake orifice;

an exhaust orifice; and a combustion chamber comprising a piston, comprising:

a cylindrical body; and a cylindrical extension wall extending from one end of said cylindrical body, wherein said wall encloses a hollow cylindrical area on said end of said cylindrical body;

wherein said extension wall is continuous and does not extend into said head;

whereby said extension wall seals said intake orifice and said exhaust orifice during the cyclical operation of said combustion chamber.

* * * * *